United States Patent [19]

Tschappat, Jr.

[11] Patent Number: 4,557,352

[45] Date of Patent: Dec. 10, 1985

[54] APPARATUS AND METHOD FOR DRIVE-UP BANKING

[75] Inventor: Robert W. Tschappat, Jr., Englewood, Colo.

[73] Assignee: United Banks of Colorado, Inc., Denver, Colo.

[21] Appl. No.: 549,064

[22] Filed: Nov. 7, 1983

[51] Int. Cl.[4] ..... E04H 1/12

[52] U.S. Cl. ..... 186/37; 52/67; 109/2; 194/DIG. 26

[58] Field of Search ..... 186/37, 41; 221/281; 235/379; 194/DIG. 26; 109/2, 10, 19, 45, 49; 52/29, 33, 67; 312/25, 29, 122, 132, 205, 212, 250, 270

[56] References Cited

U.S. PATENT DOCUMENTS

| | | | |
|---|---|---|---|
| Re. 22,431 | 2/1944 | Sloan | 52/29 X |
| 362,200 | 5/1887 | Campbell . | |
| 1,696,189 | 12/1928 | Castagna . | |
| 2,963,333 | 12/1960 | Mestre | 346/22 |
| 3,059,840 | 10/1962 | Graber et al. | 232/44 |
| 3,148,640 | 9/1964 | Billi | 109/5 |
| 3,598,039 | 8/1971 | Bryant | 98/33 |
| 3,697,729 | 10/1972 | Edwards et al. | 194/DIG. 26 |
| 4,026,616 | 5/1977 | Kuehl | 312/250 |
| 4,256,355 | 3/1981 | Yamaguchi et al. | 312/198 |
| 4,327,530 | 5/1982 | Bush | 52/66 |
| 4,350,264 | 9/1982 | Muller | 221/281 X |
| 4,399,755 | 8/1983 | Wiedmann | 109/2 |
| 4,417,527 | 11/1983 | Williams et al. | 109/2 |

FOREIGN PATENT DOCUMENTS

| | | | |
|---|---|---|---|
| 2026057 | 1/1980 | United Kingdom | 52/67 |

*Primary Examiner*—F. J. Bartuska

*Attorney, Agent, or Firm*—Sheridan, Ross & McIntosh

[57] ABSTRACT

A drive-up banking system having a plurality of automatic teller machines located on a plurality of islands with a driveway for each island is provided. The drive-up banking system is designed so that the automatic teller machines may be moved out of a housing to provide a space for a mechanic to perform the necessary servicing of one automatic teller machine and not interfere with the normal operation of any adjacent automatic teller machine.

20 Claims, 6 Drawing Figures

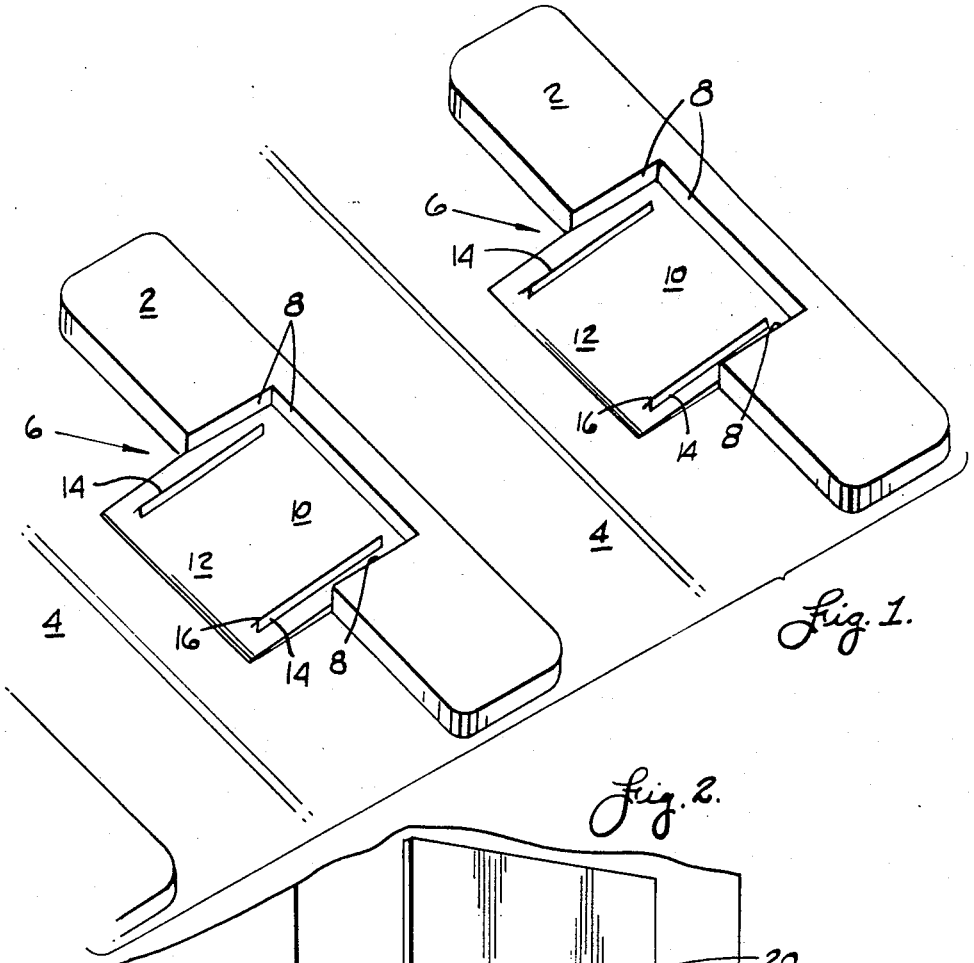
Fig. 1.
Fig. 2.
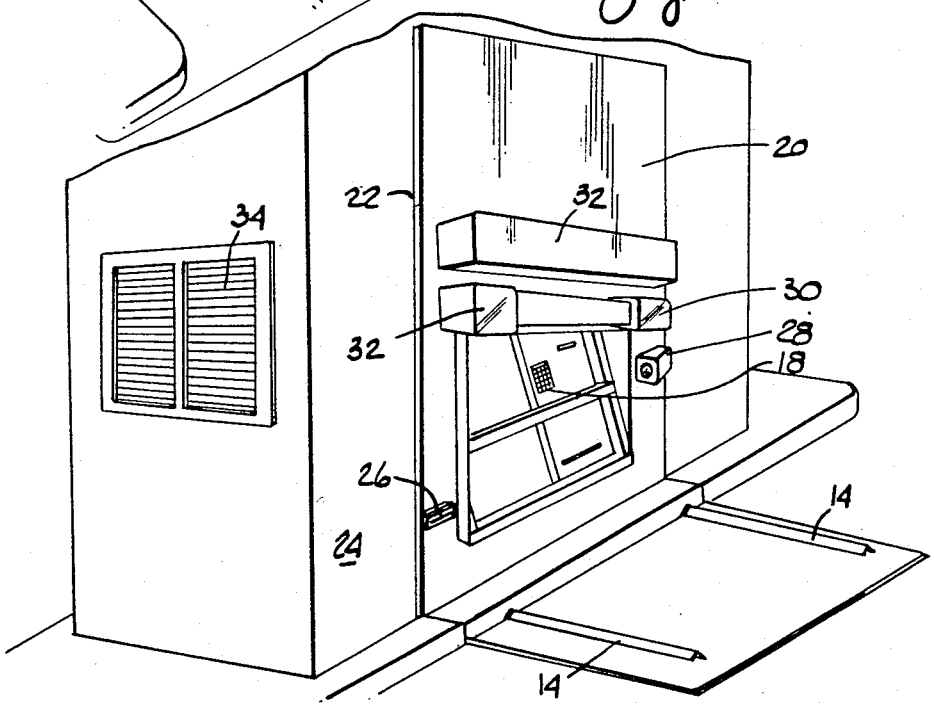

Fig. 4.
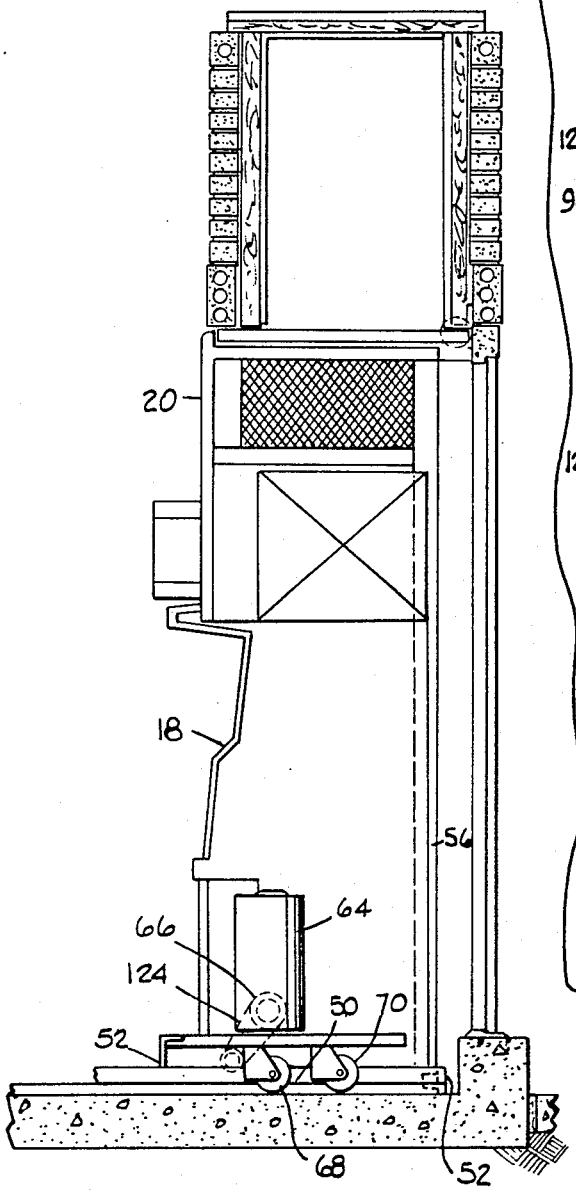
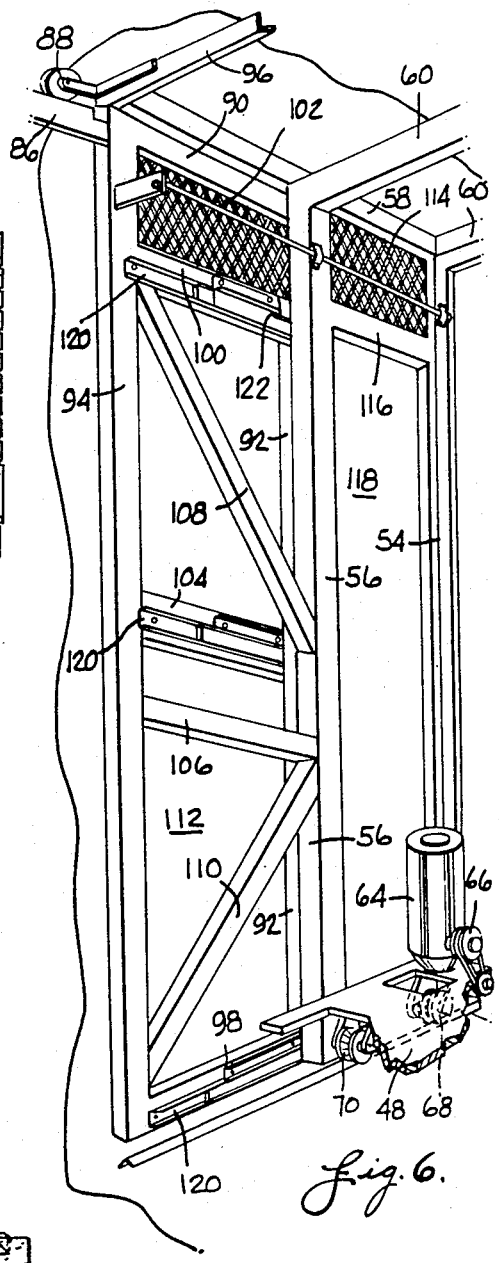
Fig. 6.

APPARATUS AND METHOD FOR DRIVE-UP BANKING

FIELD OF THE INVENTION

This invention relates generally to the field of drive-up banking services wherein banking service means are located on islands having a driveway associated with each of the islands so that a vehicle may be driven over the driveway to a location adjacent the banking service means. The invention is more particularly directed to the provision of automatic teller machines as the banking service means and providing such automatic teller machines with apparatus and method for permitting the servicing of one of the automatic teller machines without interfering with the normal operation of any of the other automatic teller machines.

BACKGROUND OF THE INVENTION

For many years now, practically all banks have provided some type of banking service wherein a customer may drive up to some type of banking service means to conduct banking services. One type of such drive-up banking services comprises a plurality of islands each having a driveway adjacent thereto over which a customer may drive a vehicle. Each island is provided with some type of banking service means. Generally, one or more human tellers are located in a housing adjacent the islands and each teller will handle the requirements of a plurality of the banking service means. In this type of operation, the customer will place his desired banking services in a container which will be conveyed to one of the tellers who will conduct the services and then return any necessary items to the customer. A more recent development relates to the use of an automatic teller machine. In this type of operation, the automatic teller machine is located in some type of a building so that the equipment necessary to operate an automatic teller machine will be protected from the elements and space will be available for a mechanic to perform the necessary maintenance of the automatic teller machine and the equipment associated therewith. These requirements of protection and space have been detrimental to the use of automatic teller machines in a drive-up banking service comprising the use of a plurality of islands.

BRIEF SUMMARY OF THE INVENTION

This invention provides apparatus and method for a drive-up banking service which permits the use of automatic teller machines located in housings on a plurality of islands wherein each island is provided with a driveway over which a customer may drive a vehicle to a location adjacent an automatic teller machine. The customer may conduct his required banking service while remaining in the vehicle and then drive off. When it is desired to perform necessary services on the automatic teller machine or the equipment associated therewith, the automatic teller machine is moved out of its housing to a position over a portion of the driveway associated with the automatic teller machine requiring service. The mechanic can then enter the space in the housing vacated by the automatic teller machine and perform any necessary service.

In the preferred embodiment of the invention, a housing is provided on each of the islands. The housing is large enough so that an automatic teller machine and all of the equipment necessary for the operation and protection of the automatic teller machine may be mounted in the housing and protected from the elements while still providing for drive-up services. The space in the housing in which the automatic teller machine is positioned has a surface which is substantially a continuation of the upper surface of the driveway associated with the automatic teller machine. A pair of parallel rails are mounted in the surfaces involved so that a portion of each rail is in the housing and a portion of each rail is in the driveway. The automatic teller machine is supported in a frame and is provided with a plurality of wheels in contact with the rails. Means are provided to move the automatic teller machine over the rails from a position within the housing to a position over the driveway. When it is desired to perform nececessary services, the automatic teller machine is moved to its position over the driveway and the mechanic can then enter into the space vacated by the automatic teller machine to perform the necessary services. Since the mechanic is within the housing, normal banking services may be performed by the automatic teller machine on the island next to the automatic teller machine being serviced. After the necessary services have been completed, the automatic teller machine is moved back into its position in the housing and normal banking services are resumed.

It is an object of this invention to provide drive-up banking services using a plurality of spaced apart islands with an automatic teller machine on each island.

It is another object of this invention to provide apparatus and method for permitting the servicing of one of the automatic teller machines without preventing the normal operation of any of the other automatic teller machines.

It is a further object of this invention to provide apparatus and method so that an automatic teller machine may be readily moved from a position in a housing to a position over the driveway associated with that automatic teller machine so that a mechanic can enter the space in the housing vacated by the automatic teller machine and perform the necessary services.

Other features and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

BRIEF DESCRIPTION OF THE DRAWINGS

FIG. 1 is a perspective view of a plurality of islands and illustrating the portions in which the automatic teller machines are located;

FIG. 2 is a pictorial view of the automatic teller machine in operable position;

FIG. 4 is a schematic side elevation view of the automatic teller machine in position in the housing;

FIG. 6 is a pictorial view of one side of the structure for supporting and moving the automatic teller machine.

DETAILED DESCRIPTION OF THE INVENTION

Figure 3:
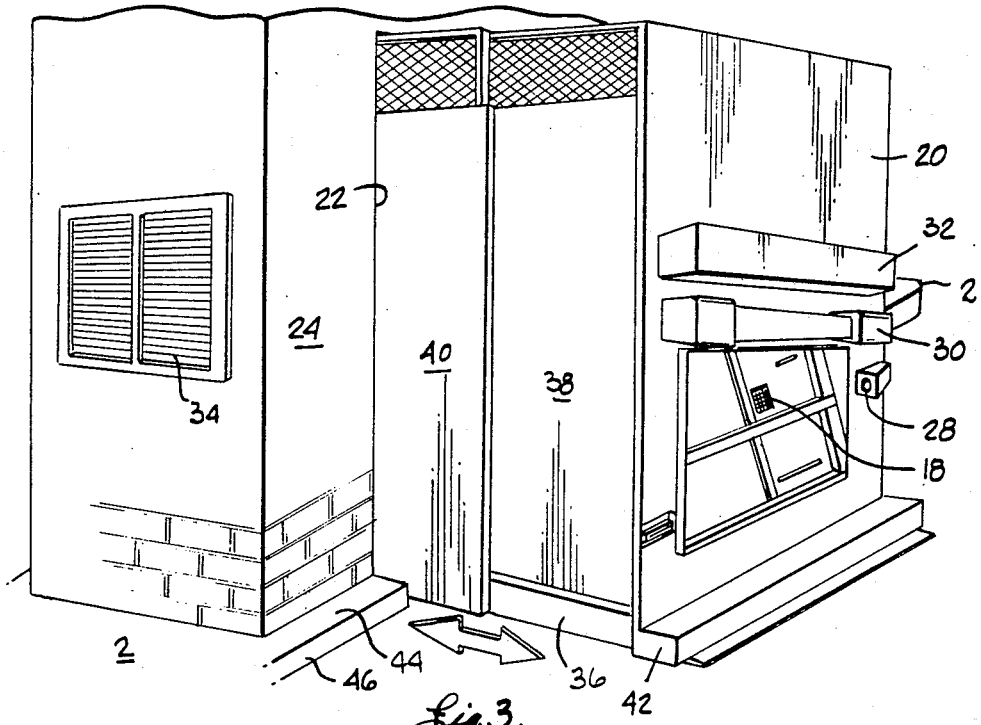
FIG. 3 is a pictorial view of the automatic teller machine in extended position.

In FIG. 1, there is illustrated the general layout for a plurality of islands 2 each having a length, width and height of standard dimensions. In front of each island 2 is a driveway 4 of conventional design. In the preferred embodiment of the invention, each island 2 has an opening 6 defined by the walls 8 so that the base 10 of the opening is at substantially the same elevation as the driveway 4 with a portion 12 of the base 10 occupying a portion of the driveway 4. Two parallel rails 14 are fixedly secured in the base 10 and portion 12 so that the rails 14 extend upwardly from the base 10 and portion 12. As illustrated in FIG. 1, the rails 14 are triangular in cross-section with the apex 16 being located the greatest distance from the base 10 and portion 12. The driveway 4 and portion 12 are sloped downwardly from the island 2 and base 10 to allow for drainage.

The automatic teller machine 18 is shown in its operable opposition in FIG. 2 and in its extended position in FIG. 3. The automatic teller machine 18 is located in a panel 20 that fits in an opening 22 in the housing 24 built on the upper surface of each island 2. The housing 24 extends around the opening 6 and has sufficient heighth, depth and length so that suitable equipment required for the normal operation of the automatic teller machine 18 may be located therein. The automatic teller machine 18 is also provided with conventional equipment mounted in the panel 20 such as a supply of envelopes 26, a camera 28, lights 30 and a facade 32. An air conditioning vent 34 is located in a wall of the housing 24.

As illustrated in FIG. 3, the panel 20 is secured to a frame 36 (to be described below) having wheels for guiding the movement of the automatic teller machine 18 (also supported on the frame 36) out of and back into the housing 24. Also illustrated in FIG. 3 are panels 38 and 40 which are provided with means (described below) so that when the automatic teller machine 18 is in the closed position, the panel 38 is telescoped within the panel 40 and each are retracted fully within the housing 24. At the bottom of the panel 20, there is located a base 42 that extends outwardly from the panel 20. The base 42 has a configuration to mate with the upper 44 and side 46 surfaces of the island 2 so as to form a continuation of these surfaces in front of the the automatic teller machine 18.

Figure 5:
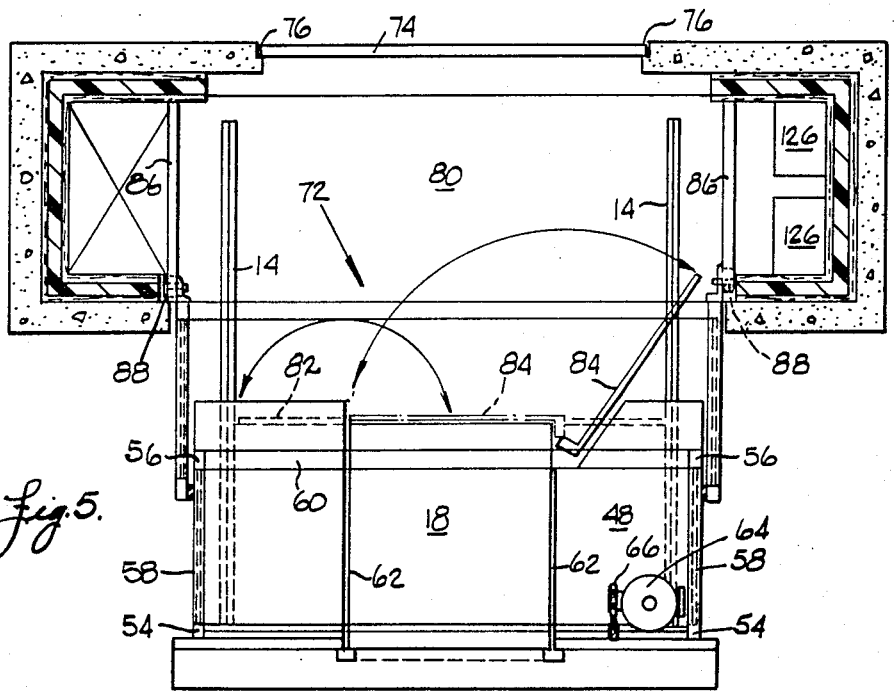
FIG. 5 is a schematic open top plan view showing the interior of the housing with the automatic teller machine in a position over the driveway.

The automatic teller machine 18 and the structure for supporting and moving it are illustrated in FIGS. 4, 5 and 6. The automatic teller machine 18 is mounted on a base 48 which is supported on a frame 36 comprising two base side beams 50; two base cross beams 52. Also supported by the frame 36 are two front upstanding beams 54, two rear upstanding beams 56, two upper side beams 58 and two upper cross beams 60 for a purpose to be described. The automatic teller machine 18 is mounted substantially in the middle of the base 48 with the sidewalls 62 of the automatic teller machine 18 being spaced equally from each side beam 58 (FIG. 5).

Movement of the automatic teller machine 18 is generated by electric motor 64 connected by suitable drive means 66 to drive wheel 68 which is mounted on one of the side base beams 50 so that it is free to rotate. A freely rotatable idler wheel 70 is mounted on the same side beam 50. A driven wheel and an idler wheel (not shown) are mounted in the other side base beam. All of the wheels are in contact with the rails 14 and have surface configurations which will mate with the surface configuration of the rails 14 so that the wheels will both move and guide the automatic teller machine 18 out of and back into the housing 24. The frame 36 and its associated structure are designed so that they telescope into another frame 72, the structure of which will be described more fully in relation to FIG. 6. A door 74 covers an entrance opening 76 into the housing 24 so that a mechanic can enter and occupy the space 80 vacated by the automatic teller machine 18 and perform any maintenance required. This provision allows the spacing between adjacent islands to be held to a minimum. Also since the automatic teller machine 18 is substantially in the middle, access doors, such as those at 82 and 84, may be readily opened.

The mechanism for supporting and moving the automatic teller machine 18 is illustrated in FIG. 6. Only one side of the mechanism is illustrated in FIG. 6, it being understood that the other side is substantially the same. A pair of tracks 86 are permanently mounted in the housing 24. A pair of rollers 88 supported on the frame 72 are located to roll over the tracks 86 to support the frame 72 during movement. The frame 72 comprises two upper side beams 90, two front upstanding beams 92, two rear upstanding beams 94, two upper cross beams 96, and two base side beams 98. A brace 100 extends between a front upstandinding beam 92 and a rear upstanding beam 94. Wire screening 102 is secured to beams 90, 92, 94 and brace 100. Additional support is provided by braces 104 and 106 and diagonal cross beams 108 and 110. The outer surface of the area enclosed by the brace 100, and beams 92, 94 and 98 is covered by sheet metal 112 for protection when the automatic teller machine 18 is in an extended position. The frame 36 is similarly constructed with wire screening 114 secured to beams 58, 54, 56 and brace 116 and sheet metal 118 covering the outer surface of the area enclosed by brace 116 and beams 54, 56 and 50. Three sets of guide and support means 120 and rollers 122 are secured to the beams 92 and 94 and 54 and 56 and function to guide and support the frame 72 during movement thereof. The frame 36 and 72 are dimensioned so that the frame 36 will telescope into the frame 72 and both frames 36 and 72 in telescoped position will be within the housing 24 for normal operation.

The means for generating movement of the automatic teller machine 18 comprises the electric motor 64 which drives a gear 66. A chain 124 is trained around gear 66 and is suitably trained around another gear (not shown) secured to a drive shaft that is operatively connected to means for driving the wheels 68. Suitable means 126 are located in the housing 24 to provide electric power and control means for operation and movement of the automatic teller machine 18.

In normal operation, the automatic teller machine 18 is in the position illustrated in FIGS. 2 and 4 wherein the automatic teller machine 18 is within the housing 24. A customer may drive up over the driveway 4 to a location in front of the automatic teller machine 18 and conduct desired banking business. When service of the automatic teller machine 18 is required, suitable means are located on the driveway 4 to close the driveway. Means 126 are actuated to drive the electric motor 64 to move the automatic teller machine to an extended position as illustrated in FIGS. 3, 5 and 6. A mechanic may then enter into the housing 24 and into the space 80 (vacated by the automatic teller machine 18) and perform the necessary service. Therefore, only the driveway 4 of the automatic teller machine 18 being serviced is blocked so that normal operation of the other automatic teller machine 18 units may continue.

While the preferred embodiments of the invention have been illustrated and described herein, it may be otherwise embodied and practiced within the scope of the following claims.

What is claimed is:

1. Banking apparatus comprising:

a plurality of islands having a length, width and depth;

a driveway in front of each island so that one driveway is between adjacent islands;

an automatic teller machine located on each of said islands so that vehicles may be moved over each of said driveways and banking business may be conducted at each of said automatic teller machines, at least a first of said automatic teller machines having a first portion, said first portion being used in controlling operation of said first automatic teller machine, said first automatic teller machine also having a second portion operatively associated with said first portion;

a housing in which said first automatic teller machine is normally in a first closed position for conducting banking business, said housing including a front panel in which said first portion is positioned;

means for permitting movement of said first automatic teller machine from said first closed position to a second position, said second position being over said driveway in front of said first automatic teller machine; and an entryway in said housing permitting access to said second portion of said first automatic teller machine, said entryway being located separate and away from said first portion of said automatic teller machine, said front panel remaining unopened while gaining access to said second portion when said first automatic teller machine is in said second position so that a mechanic may enter said housing to service said first automatic teller machine without blocking the driveway of an adjacent automatic teller machine.

2. Apparatus as in claim 1 wherein:

each of said automatic teller machines is a self-contained machine having access doors which may be opened for servicing or repairing of said automatic teller machines.

3. Apparatus as in claim 1 wherein:

each of said automatic teller machines is securely mounted on a frame.

4. Apparatus as in claim 3 wherein said means for permitting movement of each of said automatic teller machines comprises:

means for supporting each of said automatic teller machines on a frame; and means for permitting movement of said frame to positions within and outside of said housing.

5. Apparatus as in claim 4 wherein said means for permitting movement comprises:

a pair of parallel spaced rails; each of said rails having a portion in said housing and a portion in said driveway in front of said automatic teller machine; and a plurality of wheels mounted on said frame with portions of said wheels in contact with each of said rails so that said wheels may roll over said rails.

6. Apparatus as in claim 5 and further comprising:

means for guiding the movement of said frame over said rails.

7. Apparatus as in claim 5 and further comprising:

means for rotating some of said wheels to move said automatic teller machine over said rails to positions inside or outside of said housing.

8. Apparatus as in claim 7 wherein:

said frame comprises a plurality of sections which may be telescoped one within another.

9. Apparatus as in claim 5 and further comprising:

a cut out portion in said island in which said automatic teller machine is located when in operative position within said housing; and a platform secured to said frame;

said platform having outside dimensions so that the surface contours of said island remain substantially continuous in the area between said automatic teller machine and said driveway.

10. Apparatus as in claim 9 wherein:

said cut out portion has a length slightly greater than the coresponding dimension of said frame; a depth substantially equal to the depth of said island and a width less than the width of said island but greater than one half the width of said island.

11. Apparatus as in claim 10 wherein:

said housing has outside dimensions in a direction corresponding to the length of said island greater than the length of said cut out portion; in a direction corresponding to the width of said island a width less than the width of said island; and a height greater than said frame; and said housing has inside dimensions so that external equipment required for the normal operation of an automatic teller machine may be located within said housing and not interfere with the movement of said automatic teller machine over said rails to positions inside and outside of said housing.

12. Apparatus as in claim 5 wherein:

the portions of said rails in said driveway are lower in relation to a horizontal plane passing through said rails than the portion of said rails in said housing to provide for proper drainage.

13. Apparatus as in claim 12 wherein:

said rails in relation to said horizontal plane are inverted V-shaped in cross-section; and said wheels have countours to mate with said rails.

14. Apparatus as in claim 6 wherein said means for guiding the movement of said frame comprises:

corresponding mating surfaces on said rails and said wheels.

15. Apparatus as in claim 14 wherein:

said frame comprises a plurality of sections which may be telescoped one within another; and means secured respectively to said one and said another of said sections for guiding and supporting of said sections during movement relative to each other.

16. Apparatus as in claim 15 wherein:

each of said automatic teller machines is securely mounted in one of said one of said sections.

17. Apparatus as in claim 16 and further comprising:

means for rotating at least one of said wheels to move said automatic teller machine over said rails to positions inside or outside of said housing.

18. Apparatus as in claim 17 wherein:

the portions of said rails in said driveway are lower in relation to a horizontal plane passing through said rails than the portion of said rails in said housing to provide for proper drainage;

said rails in relation to said horizontal plane are inverted V-shaped in cross-section; and said wheels have countours to mate with said rails.

19. In a method of conducting a drive-up banking system comprising a plurality of islands and a driveway in front of each island over which vehicles may pass, the improvement comprising:

providing an automatic teller machine on a plurality of said islands, at least a first of said automatic teller machines having a first portion, said first portion being used in controlling operation of said first automatic teller machine, said first automatic teller machine also having a second portion operatively associated with said first portion;

providing a protective housing for each of said automatic teller machines, said housing including a front panel in which said first portion is positioned;

providing means for permitting movement of said first automatic teller machine from a first position to a second position, said second position being over a portion of said driveway adjacent to said first automatic teller machine;

moving said first automatic teller machine to said second position over said driveway; and entering said first automatic teller machine by an entryway in said housing to gain access to said second portion of said first automatic teller machine, said entryway being located separate and away from said first portion of said automatic teller machine and wherein said front panel remains unopened while gaining access to said second portion of said first automatic teller machine so that a mechanic may enter said housing to service said first automatic teller machine without blocking the driveway of an adjacent automatic teller machine.

20. A method as in claim 19 wherein:

said step of moving said first automatic teller machine includes telescoping at least a first panel of said housing relative to remaining portions of said housing.

* * * * *